US006287042B1

(12) United States Patent
Eriksson

(10) Patent No.: US 6,287,042 B1
(45) Date of Patent: Sep. 11, 2001

(54) METHOD AND ARRANGEMENT AT A FLAGPOLE

(75) Inventor: Bernt Eriksson, Tidaholm (SE)

(73) Assignee: Tidaflag AB, Tidaholm (SE)

( * ) Notice: Subject to any disclaimer, the term of this patent is extended or adjusted under 35 U.S.C. 154(b) by 0 days.

(21) Appl. No.: 09/284,827

(22) PCT Filed: Oct. 27, 1997

(86) PCT No.: PCT/SE97/01786

§ 371 Date: Apr. 21, 1999

§ 102(e) Date: Apr. 21, 1999

(87) PCT Pub. No.: WO98/19030

PCT Pub. Date: May 7, 1998

(30) Foreign Application Priority Data

Oct. 31, 1996 (SE) ..... 9603994

(51) Int. Cl.[7] ..... F16B 12/00

(52) U.S. Cl. ..... 403/267; 403/298; 116/173

(58) Field of Search ..... 403/292, 295, 403/298, 361, 383, 375, 267, 268; 116/173; 52/726.3, 726.1

(56) References Cited

U.S. PATENT DOCUMENTS

| | | | | |
|---|---|---|---|---|
| 822,405 | | 6/1906 | Teese . | |
| 1,102,413 | | 7/1914 | Jensen . | |
| 1,633,798 | * | 6/1927 | Taylor | 403/298 X |
| 3,253,846 | * | 5/1966 | Garcia | 52/726.1 X |
| 4,407,505 | * | 10/1983 | Kendziorski | 116/173 X |
| 4,461,509 | * | 7/1984 | Yaotani et al. | 403/292 X |
| 4,958,953 | * | 9/1990 | Charondiere | 403/295 X |
| 5,052,848 | * | 10/1991 | Nakamura | 403/268 |
| 5,383,420 | * | 1/1995 | Dundorf | 116/173 X |
| 5,495,821 | | 3/1996 | Brewer . | |
| 5,660,492 | * | 8/1997 | Bathon | 403/267 |

FOREIGN PATENT DOCUMENTS

| | | |
|---|---|---|
| 1133687 | 4/1957 | (FR) . |
| 464037 | 2/1991 | (SE) . |

OTHER PUBLICATIONS

Copy of the International Search Report for PCT/SE97/01786.

* cited by examiner

*Primary Examiner*—Harry C. Kim
(74) *Attorney, Agent, or Firm*—Merchant & Gould P.C.

(57) ABSTRACT

The present invention relates to a process and a device for dividing a tubular flagpole. This is achieved by introducing into the flagpole an elongated body, which over at least part of its length has a geometric shape, which in concert with a complementary geometric shape inside the flagpole ensures that the flagpole can be cut and assembled in a way that guarantees the rectilinear continuity of the flagpole. The complementary geometric shape is formed in that, after the body is introduced into the flagpole, a filling material is injected so that the space between the flagpole and the elongated body is filled. The flagpole is then cut around the elongated body down to the outer surface of the body so that the geometric shape allows the flagpole to be divided into two sections at the cutting side, the body remaining fixed to one of the sections.

16 Claims, 2 Drawing Sheets

METHOD AND ARRANGEMENT AT A FLAGPOLE

Figure 1:
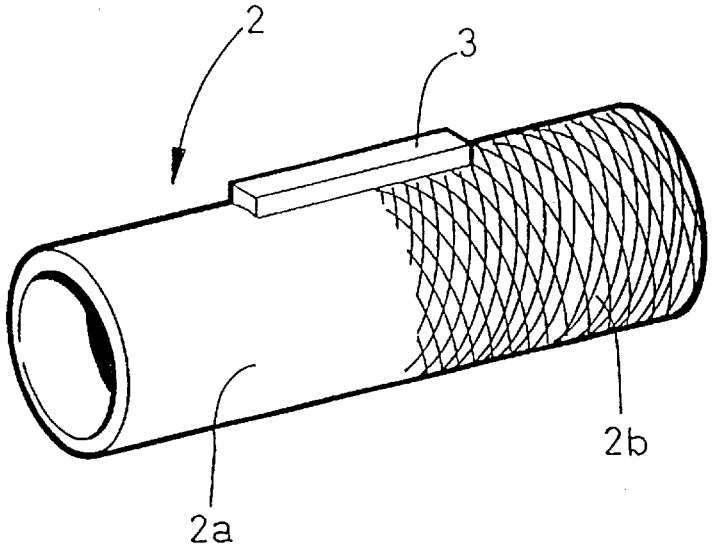

The present invention relates to a process for dividing a tubular flagpole.

The invention also relates to a device in a tubular flagpole, divisible into a first and a second flagpole section.

Flagpoles are often very long. This may cause difficulties, for example, when transporting them, partly for reasons of space and partly because they are awkward to handle. It is therefore desirable that the flagpoles be divisible into two or more parts.

A device for achieving a rigid and rattle-free connection of two flagpole sections is already known from SE 464 037. The device is used to connect two tubes of different diameter, where the outside diameter of the first tube is smaller than the inside diameter of the second tube. The first tube has two sleeves with a plurality of peripheral slots, designed to receive O-rings. The first sleeve is arranged at a free end of the first tube and the second sleeve is arranged further in on the tube. The second sleeve, at the end furthest away from the first sleeve, is equipped with a flange, the diameter of which is greater than the inside diameter of the second tube. When connecting the sections of the flagpole, the first tube provided with sleeves is inserted into the second tube so that the first sleeve is situated entirely inside this tube and the second sleeve is situated partially inside this tube, with its flange resting against the end of the second tube. The O-rings on the sleeves are designed so that they come into contact with the inside of the second tube, thereby achieving a rattle-free connection.

A disadvantage with this device is that it requires flagpole sections of different diameters. This means that these flagpoles differ significantly in appearance from conventional, non-divisible flagpoles.

A flagpole of tubular metal sections with successively diminishing diameters, which are connected by pipe studs inserted into the ends of the tubular sections, which connect the tubular sections to one another, is already known from U.S. Pat. No. 1,102,413. The tubular sections have been shrunk fast in the pipe stubs and their projecting parts are provided with external threads corresponding with internal threads on a coupling piece, which connects the tubular sections in that their respective threaded pipe studs are firmly screwed into this coupling piece.

A disadvantage with this flagpole is that the joints are made up of a plurality of components which require accurate assembly and adjustment in order to achieve a satisfactory joint. The coupling piece in this device is clearly visible on the outside of the flagpole when the two flagpole sections are assembled. Furthermore this device also involves coupling together flagpole sections of different diameter, which means that the flagpole differs significantly in appearance from conventional, non-divisible flagpoles.

An object of the invention is to arrive at a method by means of which the disadvantages associated with previously known solutions are overcome, in which method

- an elongated body is chosen, which over at least one part of its length has a geometric shape, which in its interaction with a complementary geometric shape inside the flagpole ensures that the flagpole can be cut and assembled in a way that guarantees that the flagpole remains straight when assembled, and over its entire length has an outside dimension less than the inside diameter of the flagpole,
- non-stick agent is applied to the outer surface of the elongated body on a part of its length, including one end of the body and at least one part of the said geometric shape,
- the elongated body is inserted into the flag pole and placed with its centre essentially where division is required,
- a seal is produced between the flagpole and the elongated body at both ends of the body, thereby forming an enclosed space,
- at least one hole is made though the wall of the flagpole so that the hole(s) communicate(s) with the enclosed space,
- a filling material, preferably thermosetting plastic, is injected through the hole(s) (6*a*, 6*b*) so that the space between the flagpole and the elongated body is filled, thereby forming the said complementary geometric shape,
- the filling material is allowed to set, so that the elongated body is thereby fixed to the flagpole by that part of its outer surface to which non-stick agent has not been applied,
- the flagpole is cut away around the elongated body, at an area on this to which non-stick agent has been applied, down to the outer surface of the body, so that a certain length of the body remains on both sides around the cutting site, and so that it is possible to divide the flagpole into two parts at the cutting site, the body remaining fixed to one of the parts.

According to another characteristic of the invention the elongated body is a tube, in which case it is possible to form the enclosed space by introducing an expandable agent, in one simple, advantageous embodiment a rubber bladder, into the tube and causing this to expand so that it protrudes from the tube at both ends thereof and in such a way as to form a seal between the tube and the flagpole, as a result of which the tube is also centered in the flagpole.

According to a further characteristic of the invention a plurality of elongated bodies are arranged in the flagpole in order to permit dividing at a plurality of points.

Another object of the invention is to produce a device by means of which the above-mentioned disadvantages are overcome. This is achieved by the invention in that a tube is introduced and fixed in the first flagpole section at its end corresponding to the second flagpole section, so that one part of the tube protrudes from the first flagpole section, the protruding part of the tube having a geometric shape corresponding to a complementary geometric shape inside the second flagpole section at its end corresponding to the first flagpole section, in which the said fixing and said complementary geometric form are respectively produced by the injection of a filling material, preferably thermosetting plastic, between the tube and the flagpole so that, after setting, this filling material together with the tube with the said geometric shape mean that the flag pole, after dividing around the tube down to this can only be assembled in a way that guarantees that the flagpole remains straight.

In order to obtain an uncomplicated design, the said geometric shape, according to a further characteristic of the invention, comprises at least one guide extending along the said tube which in one simple embodiment is an axially aligned key.

According to yet another characteristic of the invention at least one part of the outer surface of that part of the tube fixed in the first flagpole section to ensure its fixing is provided with a friction-enhancing external texture, consisting in one embodiment of grooves.

Figure 2:
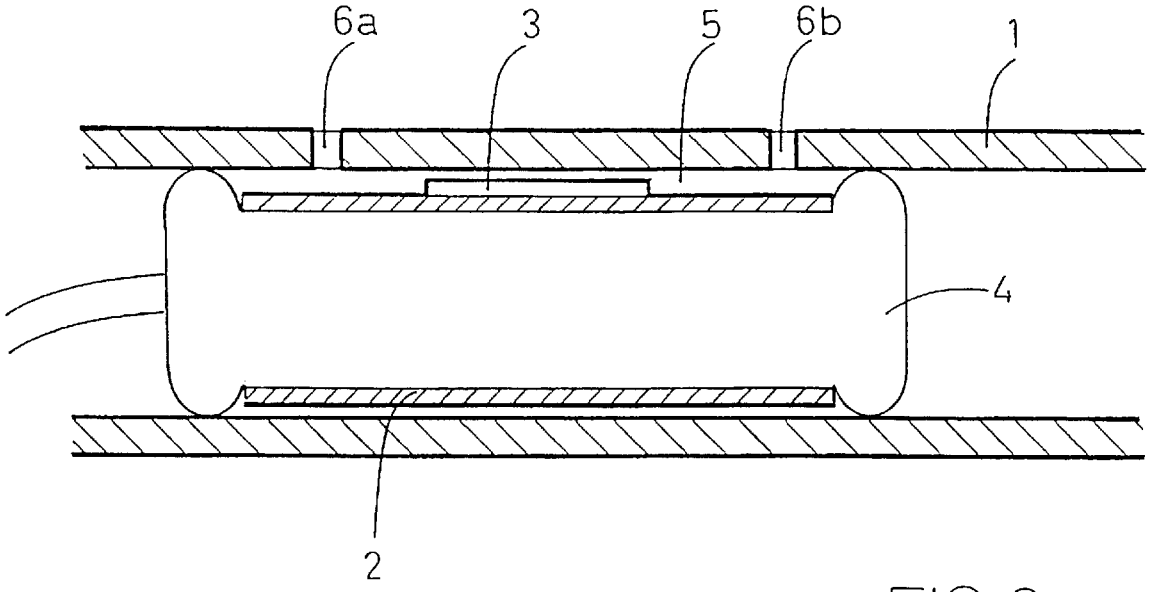
Figure 3:
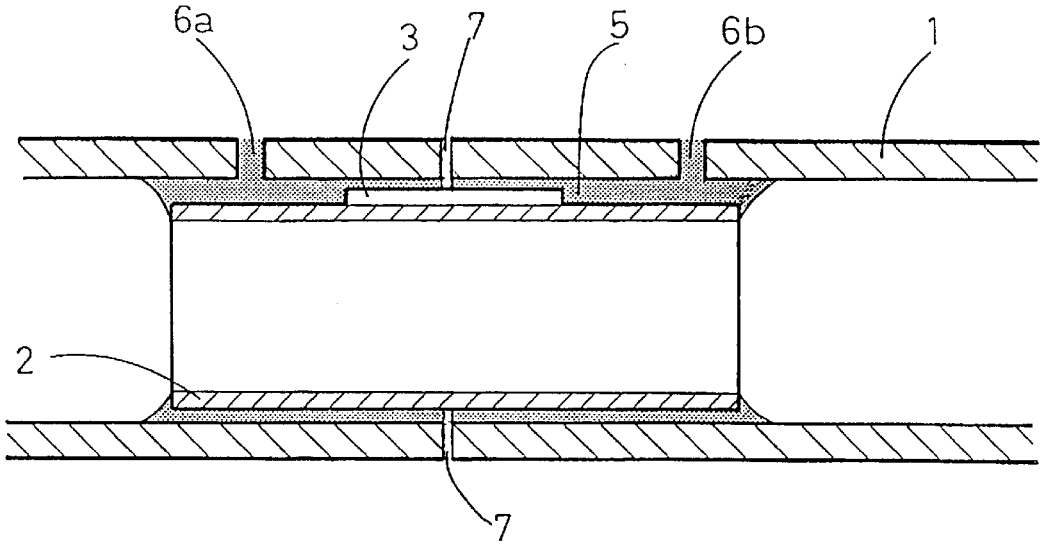
Figure 4:
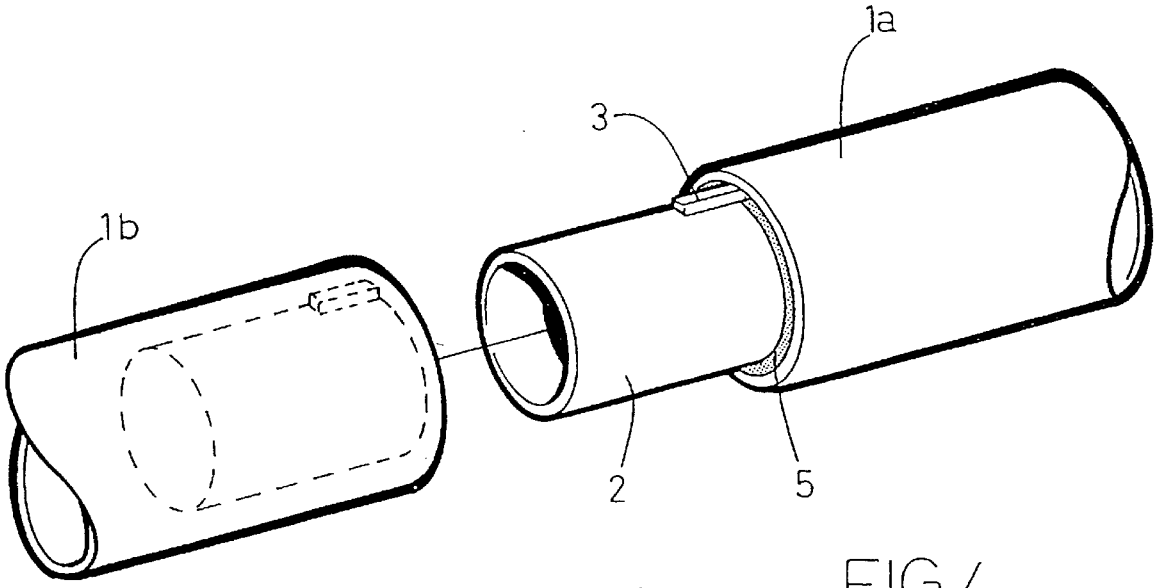

The invention will be explained in more detail below with the aid of examples and with reference to the drawings attached in which:

FIG. 1 shows a perspective view of an elongated body for use in an embodiment of the invention, FIG. 2 shows a section through the body and the flagpole at one phase in a process according to the invention, FIG. 3 shows a section through the body and the flagpole at another phase in a process according to the invention, FIG. 4 shows a perspective view of an embodiment of the device according to the invention.

FIG. 1 shows an example in which approximately half the elongated body, in this example a tube 2, has a grooved outer surface 2*b* and approximately half has an outer surface 2*a* to which a non-stick agent is applied. In addition a longitudinal key 3 is arranged approximately in the centre of the tube 2, to one part of which, corresponding to the outer non-stick coated surface 2*a*, non-stick agent is applied.

In the example in FIG. 2 the tube 2 has been placed in an axial direction in a tubular flagpole 1 with its centre approximately where the division is required. The flagpole 1 may be of prefabricated type and manufactured from glass fibre-reinforced thermosetting plastic. A rubber bladder 4 is placed inside the tube 2. This has been made to expand by filling it with air, the space between the flagpole and the tube thereby being sealed at both ends of the tube, so that an enclosed space 5 has been formed. Furthermore the said expansion results in centering of the tube 2 in the flagpole 1. The rubber bladder 4 may have been placed in the tube 2 either before this was inserted into the flagpole or afterwards. Sealing may naturally be performed in a number of other ways well-known to the person skilled in the art. In this example two holes 6*a*, 6*b* have been made through the flagpole 1 so that the holes communicate with the enclosed space.

In the example in FIG. 3 a thermosetting plastic, for example a two-component thermosetting plastic, has been injected through the holes 6*a*, 6*b* so that the enclosed space 5 between the flagpole 1 and the tube 2 is filled. In one embodiment the tube 2 and the thermosetting plastic have approximately the same coefficient of thermal expansion. In this example the rubber bladder 4 has been removed after the thermosetting plastic was injected, which is naturally not necessary. The thermosetting plastic is fixed at the flagpole 1 and the tube 2, at that part of its outer surface to which non-stick agent is not applied, by allowing it to harden. The grooves 2*b* on the outer surface of the tube 2 immersed in the thermosetting plastic make the fixing stronger.

After the thermosetting plastic has been allowed to set, the flagpole 1 is cut into two sections at a cutting site 7. The cutting is performed around the tube 2 so that the wall of the flagpole 1 and the thermosetting plastic are cut through whilst the tube 2 remains essentially intact. In one example the key 3 is at least partially severed. In this example the cutting is performed approximately in the middle of the longitudinal key 3 and where the non-stick agent is applied to this. After cutting, a length of the tube 2 remains on both sides of the cutting site. It is now possible to divide the flagpole into two sections 1*a*1*b* at the cutting site, as shown in FIG. 4, in which the tube remains fixed to the one section 1*a*. It is advantageous to perform the cutting in such a way that as small an area as possible has non-stick agent on the length to which non-stick agent is not applied to the entire outer surface.

As the example in FIG. 4 shows, the key 3 and the thermosetting plastic now ensure that assembly can only be undertaken in such a way that the flag pole regains its original alignment, that is to say just as the flagpole was aligned before it was cut off, that the assembled sections 1*a*, 1*b* cannot be twisted in relation to one another and that the rectilinear continuity of the flagpole is regained when the flagpole sections 1*a* and 1*b* are assembled.

In another example (not shown) either non-stick agent is applied to more than half of the tube 2 and less than half of the tube is grooved, or non-stick agent is applied to less than half of the tube 2 and more than half of the tube is grooved. Non-stick agent is applied to at least part of the key 3 and the cutting should be performed so that at least one part of the key 3 does not remain fixed inside the flagpole section 1*a*.

It will be obvious to the person skilled in the art that the invention is not confined to the examples described above but can lend itself to modifications within the framework of the idea of the invention defined in the claims below.

What is claimed is:

1. A device in a tubular flagpole comprising:

a first flagpole section;

a second flagpole section having in its interior a first geometric shape; and a tube that is introduced and fixed into an end of the first flagpole section;

wherein the first geometric shape is formed by injecting a filling material between the tube and the second flagpole section and wherein one end of the tube protrudes towards the second flagpole section and has a second geometric shape corresponding to the first geometric shape inside the second flagpole section.

2. A device according to claims 1, wherein said geometric shape is formed by at least one guide extending along the said tube.

3. A device according to claim 2, wherein the at least one guide is an axially aligned key.

4. The device according to claim 2, wherein the at least one guide is longitudinal.

5. A device according to claim 1, wherein at least one part of the outer surface of a part of the tube that is fixed in the first flagpole section has a friction-enhancing external texture.

6. A device according to claim 5, wherein the external texture consists of grooves.

7. The device according to claim 1, wherein the filling material is a thermosetting plastic.

8. Process for dividing a tubular flagpole, the process comprising steps of:

choosing an elongated body which over at least a part of its length has a geometric shape, which in its interaction with a complementary geometric shape inside the flagpole ensures that the flagpole can be cut and assembled in a way that guarantees that the flagpole remains straight when assembled and over all its length has an outside dimension less than an inside diameter of the flagpole;, applying a non-stick agent to an outer surface of the elongated body on a part of its length, including one end of the body and at least one part of the geometric shape;

inserting the elongated body into the flagpole so that the elongated body is placed with its center where division is required;

producing a seal between the flagpole and the elongated body at both ends of the elongated body, thereby forming an enclosed space;

making at least one hole through a wall of the flagpole so that the at least one hole communicates with the enclosed space;

injecting a filling material through the at least one hole so that the space between the flagpole and the elongated body is filled, thereby forming the complementary geometric shape;

allowing the filling material to set, so that the elongated body is fixed to the flagpole at a part of its outer surface to which said non-stick agent has not been applied; and cutting the flagpole away around the elongated body, at an area to which said non-stick agent has been applied, down to the outer surface of the elongated body, so that a certain length of the elongated body remains on both sides around the cutting site, and so that it is possible to divide the flagpole into two parts at the cutting site, the elongated body remaining fixed to one of the parts.

9. The process according to claim 8, wherein the elongated body is a tube.

10. The process according to claim 9, wherein the enclosed space is formed by introducing an expandable means into the tube and causing this to expand so that it protrudes out of the tube at both ends thereof, thereby forming a seal between the tube and the flagpole, the tube being centered in the flagpole.

11. The process according to claim 10, wherein the expandable means is a rubber bladder.

12. The process according to claim 11, wherein a plurality of elongated bodies are arranged in the flagpole in order to permit division at a plurality of points.

13. The process according to claim 10, wherein a plurality of elongated bodies are arranged in the flagpole in order to permit division at a plurality of points.

14. The process according to claim 9, wherein a plurality of elongated bodies are arranged in the flagpole in order to permit division at a plurality of points.

15. The process according to claims 8, wherein a plurality of elongated bodies are arranged in the flagpole in order to permit division at a plurality of points.

16. The process according to claim 8, wherein the filling material is a thermosetting plastic.

* * * * *